US009386863B1

(12) United States Patent
Antunovic

(10) Patent No.: US 9,386,863 B1
(45) Date of Patent: Jul. 12, 2016

(54) CHILD CARRIER AND METHODS OF USE

(71) Applicant: Robert Antunovic, Boulder, CO (US)

(72) Inventor: Robert Antunovic, Boulder, CO (US)

(73) Assignee: Boba Inc., Boulder, CO (US)

( * ) Notice: Subject to any disclaimer, the term of this patent is extended or adjusted under 35 U.S.C. 154(b) by 143 days.

(21) Appl. No.: 14/288,163

(22) Filed: May 27, 2014

Related U.S. Application Data

(63) Continuation-in-part of application No. 13/241,045, filed on Sep. 22, 2011, now abandoned, which is a continuation-in-part of application No. 12/819,102, filed on Jun. 18, 2010, now abandoned.

(60) Provisional application No. 61/841,153, filed on Jun. 28, 2013.

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
USPC ..... 224/158–161; D3/213, 214
See application file for complete search history.

(56) References Cited

U.S. PATENT DOCUMENTS 4,790,459 A * 12/1988 Moseley ..... A47D 13/025 224/159
7,575,136 B2 * 8/2009 Kernkamp ..... A45F 3/14 224/158
7,766,199 B1 * 8/2010 Caperon ..... A47D 13/025 224/158
9,185,993 B2 * 11/2015 Telford ..... A47D 13/025
2010/0308088 A1 * 12/2010 Lindblom ..... A47D 13/025 224/160

FOREIGN PATENT DOCUMENTS

JP 4170894 B2 * 10/2008 ..... A47D 13/025

* cited by examiner

*Primary Examiner* — Justin Larson
(74) *Attorney, Agent, or Firm* — Erise IP, P.A.

(57) ABSTRACT

A child carrier adapted to hold a child in front pack and back pack configurations is described. Embodiments of the child carrier include a support device implemented for persons weighing between 7-17 lbs. Generally, the support device can have a first position for persons weighing between 10-17 lbs and a second position for persons weighing between 7-10 lbs. In the first position, a concave face of the support device can be contoured to interface with torso/buttocks of an infant. In the second position, the support device can be folded together providing an area suitable for an infant.

20 Claims, 19 Drawing Sheets

CHILD CARRIER AND METHODS OF USE

CROSS-REFERENCE TO RELATED APPLICATION

This application claims the benefit of Provisional Application No. 61/841,153, filed Jun. 28, 2013. This application is a continuation-in-part of application Ser. No. 13/241,045, filed Sep. 22, 2011, which is a continuation-in-part of application Ser. No. 12/819,102, filed Jun. 18, 2010.

This application incorporates by reference in their entirety Application No. 61/841,153, filed Jun. 28, 2013, application Ser. No. 12/819,102, filed Jun. 18, 2010, and application Ser. No. 13/241,045, filed Sep. 22, 2011 each having the same title and inventor as the present application.

FIELD OF THE INVENTION

The present invention relates generally to carriers, backpacks, slings, and similar devices adapted to carrying a child on a user's back or front torso.

BACKGROUND

It can be advantageous for a person to carry a child without the person using his or her arms to secure and support the child. Similarly, it can be advantageous for a person to limit a child's mobility such that the child is kept in close proximity to the person.

Backpack and frontpack devices that facilitate holding a baby or small child exist, and some prior art backpack and frontpack devices are specifically adapted to hold the child facing inwardly, toward the person wearing the backpack or frontpack. With the child facing inwardly, the child's ventral side is against the person's torso, and the child's legs typically dangling from the device. The dangling legs can compromise the child's comfort and impair blood circulation to the child's legs.

A child's head is often relatively exposed and unsupported or poorly supported by typical prior art baby carriers. Consequently, the child's head can be vulnerable to environmental elements such as sun exposure. Moreover, the relatively poor support for the child's head can make the child vulnerable to head or neck stress or injury.

It can be convenient for a nursing mother to breast feed her baby or small child when the child is held in a frontpack orientation, at a front of the nursing mother's torso. However, prior art child carriers tend to leave a nursing mother relatively exposed while nursing, making a nursing cover desirable.

DETAILED DESCRIPTION

Figure 1:
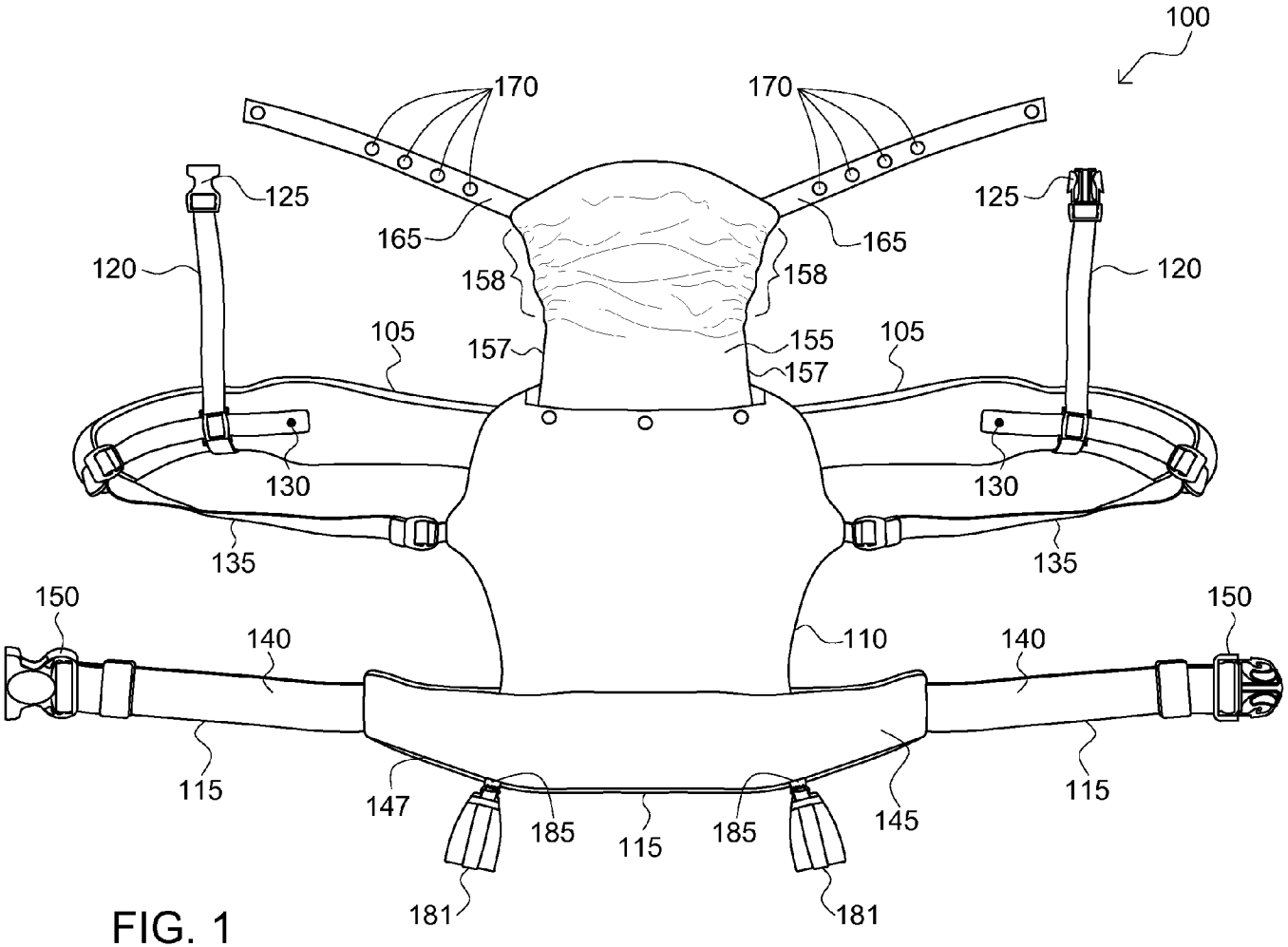
FIG. 1 is an outside perspective view of a child carrier according to an embodiment of the present invention.

Embodiments of the present invention include a child carrier adapted to being worn on a person's back or front torso, and to holding a child in a secure position at the back or front torso of the person. The child carrier is further adapted to provide support to the child's foot or leg, rather than allowing the child's leg to dangle unsupported. Leg or foot support is facilitated by foot loops. Moreover, the child carrier is adapted to support the child's head by use of a hood. Orientation of the hood is adjustable such that the hood can be used as a nursing cover to conceal or partially conceal breast feeding. Whether at the person's back or front torso, the child typically faces inwardly, the child's ventral side against the person's torso.

Some embodiments of the present invention can include a support device adapted to provide support to a torso of a child. In an embodiment, the support device can be implemented for a toddler. In an embodiment, the support device can be implemented for a newborn or infant. The support device can include a cushion having a plurality of attachment structures adapted to secure the support device to the child carrier. Generally, the support device can be in one of two positions, an extended configuration and a folded configuration. Generally, the extended configuration can be implemented with larger children and the folded configuration can be implemented with newborns or infants.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The terms "couple," "mate," "mated," or "coupled," as used in this specification and appended claims, refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object, other than an object or component whose primary function is to facilitate the coupling, resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part. "Substantially horizontal" means plus or minus 15° of horizontal.

The terms "supple," "substantially supple," "supple material," and similar terms, as used in this specification and appended claims, refer to pliant or flexible material that yields, folds, or bends with little resistance and without breaking. Supple material typically yields, folds, or bends without deforming permanently.

The term "piping," as used in this specification and appended claims, refers to a tubular band of material frequently used in textiles and familiar to persons of ordinary skill in the art.

Terms such as "above," "below," "inside," "outside," "upper," "lower," and "horizontal," as used in this specification and appended claims, refer to relative positions of identified elements, components or objects, when the child carrier is oriented as normally worn by a wearer with the wearer standing upright.

The terms "relatively broad strip," or "relatively narrow strip" as used in this specification and appended claims, refers to a strip of material at least six inches wide or less than six inches wide, respectively. Width is typically a first dimension that is smaller than a second dimension, the second dimension being perpendicular to the first dimension.

The term "inside area," as used in this specification and appended claims, refers to an area of one side (the inside) of a receptacle panel, the one side (inside) being a side of the receptacle panel that faces a wearer's body when the child carrier is worn normally. The inside area of the receptacle panel is shown in FIGS. 10 and 11. As illustrated in FIGS. 1, 4, and 6-9, the inside is not visible because it is facing away from the viewer. However, an outside of the receptacle panel is visible. An outside area and the inside area of the receptacle panel of the first embodiment child carrier are about equal in size.

The term "flexed," as used in this specification and appended claims, refers to a person's leg where the leg is bent at the knee.

A First Embodiment Child Carrier

A first embodiment child carrier 100 is illustrated in FIGS. 1-6. As shown in FIG. 1, the first embodiment child carrier comprises shoulder straps 105, a receptacle panel 110, and a waist belt 115. The receptacle panel comprises substantially supple material having sufficient inside area to substantially cradle and contain a torso of a child while the child carrier is worn by a wearer. Thus the receptacle panel has an inside area that is preferably greater than 80 square inches, more preferably between 80 and 324 square inches, and most preferably between 132 square inches and 210 square inches. The first embodiment child carrier is adapted to properly hold a child with a mass in the range of about 7 kg to 20 kg. The child carrier properly holds a child where the receptacle panel extends high on the child's back, substantially covering the child's shoulder blades and also extending upwardly from the waist belt 115 about to the child's armpits.

The shoulder straps 105 and waist belt 115 are typically padded. The shoulder straps comprise a sternum strap 120 that separates into two sections to facilitate removing the child carrier when not in use. The two sections connect by use of a sternum strap buckle 125, the sternum strap buckle including a male half and a female half familiar to persons skilled in the art. The shoulder straps further comprise snaps 130 and underarm straps 135, and each shoulder strap in the first embodiment is coupled to the receptacle panel at two connection points. Thus the shoulder straps form shoulder loops adapted to receive or encircle a wearer's shoulder.

The waist belt comprises strap portions 140 and a middle portion 145, a track 147 being disposed on the middle portion. The track of the first embodiment is piping with a diameter of about 4 mm. Ends of the strap portions are adapted to reversibly connect to each other by use of belt buckle halves 150. When the belt buckle halves are connected, the waist belt forms a loop. Typically, the loop encircles a user's torso when the child carrier is worn by a user.

The first embodiment child carrier further comprises a hood 155 and two hood straps 165. The hood comprises a relatively broad strip of supple material detachably coupled at its base to the receptacle panel 110 by three base snaps. Two hood opposite sides 157 comprise elastic portions 158 adapted to snugly cradle a child or infant's head. Each hood band comprises a relatively narrow strip of material attached to the hood at one end.

In addition, four hood securing snaps 170 disposed on each hood strap 165 are adapted to detachably engage the snaps 130 on the shoulder straps 105. Thus the hood straps are adapted to attach to the shoulder straps. An effective length of a hood strap 165 is adjusted by using a different one of the four hood securing snaps 170 to engage the snap 130. In other embodiments, fasteners such as, but not limited to, buttons or hook and loop structures, serve to detachably couple the hood straps to the shoulder straps.

Where a child resides in the child carrier 100, the hood 155 is adapted to cover and support the child's head. Support for the child's head is facilitated by engagement of the hood securing snaps 170 with the snaps 130 on the shoulder straps 105. The hood is also adapted to use as a nursing cover, i.e. to cover and conceal a child that is breast feeding while in the child carrier.

The child carrier 100 further comprises foot loops 181, the foot loops being coupled to the track 147 by use of moveable couplers 185. The moveable couplers are adapted to slide along the track 147 such that points at which the first ends attach to the waist belt can be changed by sliding the moveable couplers along the track. The moveable couplers of the first embodiment child carrier are track clips from Woojin™ Plastic. The track clips are moveable couplers that slideably attach to piping or similar cord-like structure, and are adapted to slide along the piping.

Figure 2:
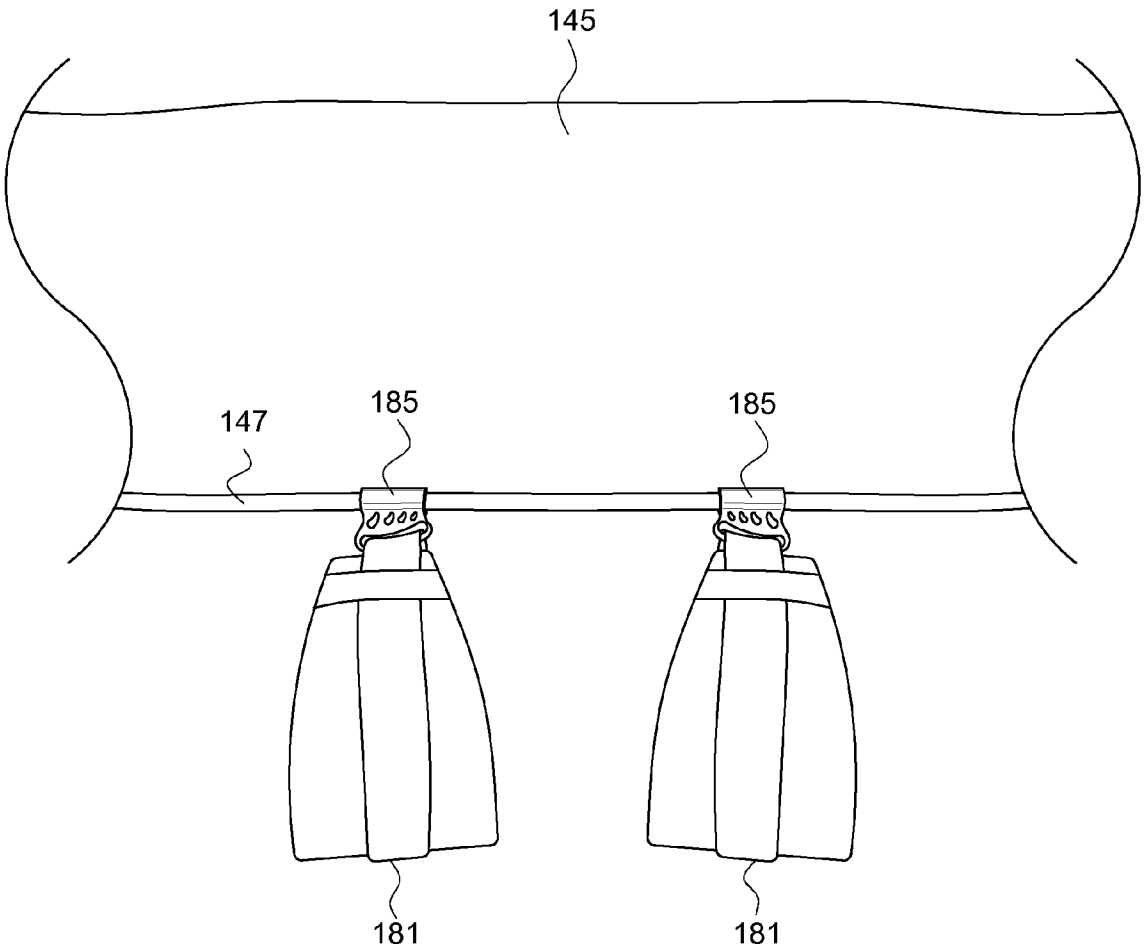
FIG. 2 is an outside view of lower support loops and a middle portion of a waist belt according to an embodiment of the present invention.

As illustrated in FIG. 2, the moveable couplers 185 of the first embodiment child carrier are closer together than in FIG. 1, having moved along the track 147, the track being disposed along a bottom of the middle portion 145 of the waist belt 115.

Figure 3:
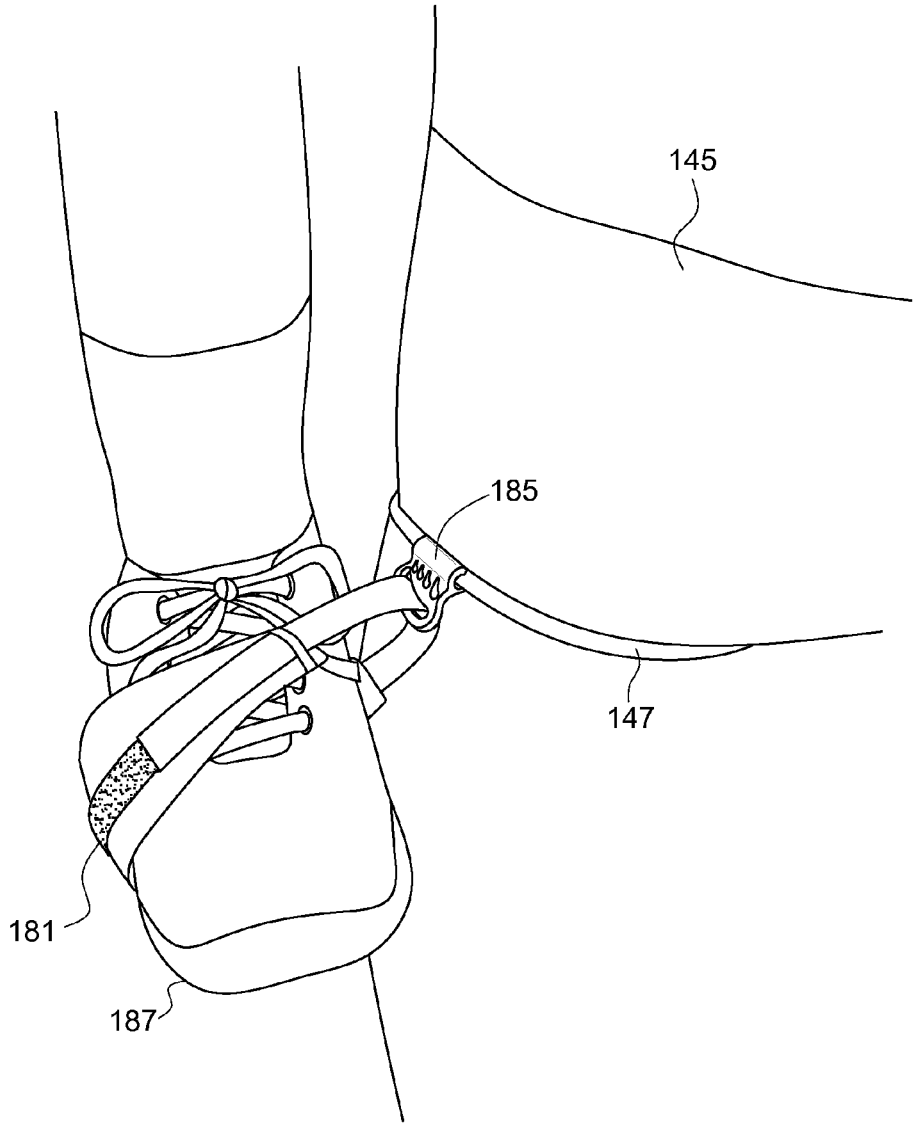
FIG. 3 is a perspective front view of a child's foot residing in a lower support loop according to an embodiment of the present invention.

As best illustrated in FIG. 3, the moveable couplers 185 partially encircle the track 147. Also as shown in FIG. 3, the foot loops 181 are adapted to perform in similar fashion to stirrups, encircling and supporting a child's foot 187. The foot loops comprise hook and loop material such as Velcro®, and are therefore size adjustable, i.e. adapted to form loops of various sizes. The foot loops are coupled to the moveable couplers.

Figure 4:
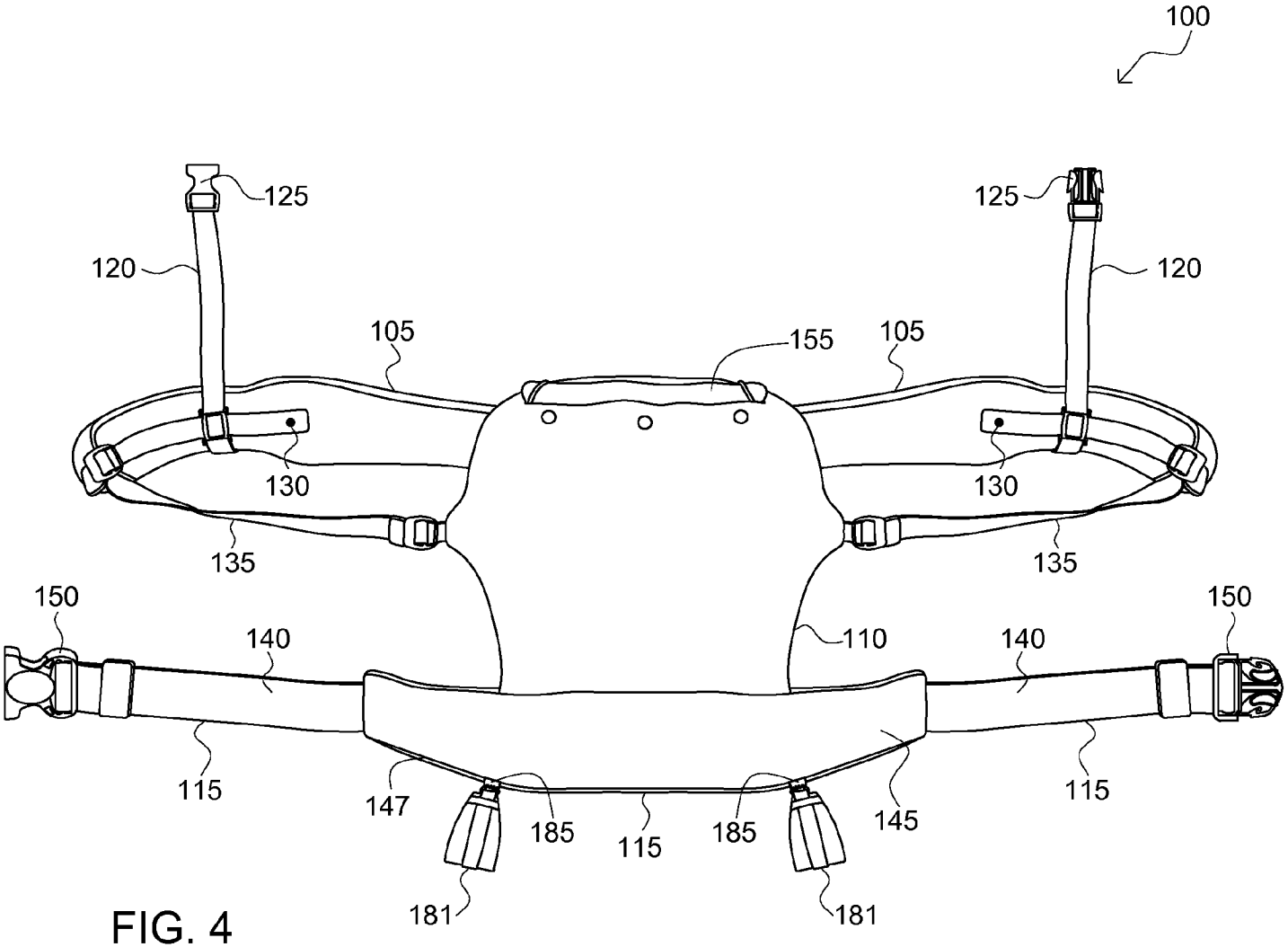
FIG. 4 is an outside perspective view of a child carrier according to an embodiment of the present invention.

The shoulder straps 105, receptacle panel 110, and middle portion 145 of the waist belt 115 of the first embodiment child carrier 100 comprise woven organic cotton fabric. In other embodiments, other fabrics are used, including, but not limited to, fabrics comprising organic cotton, hemp, silk, wool, bamboo fibers, other natural materials, rayon, polyester, polyolefins, and other synthetic materials. The underarm straps 135 and foot loops 181 of the first embodiment child carrier comprise nylon straps approximately one inch wide, but many other materials familiar to persons of ordinary skill in the art are also used in some embodiments. FIG. 4 illustrates the child carrier 100 with the hood 155 stored in a rolled configuration.

Figure 5:
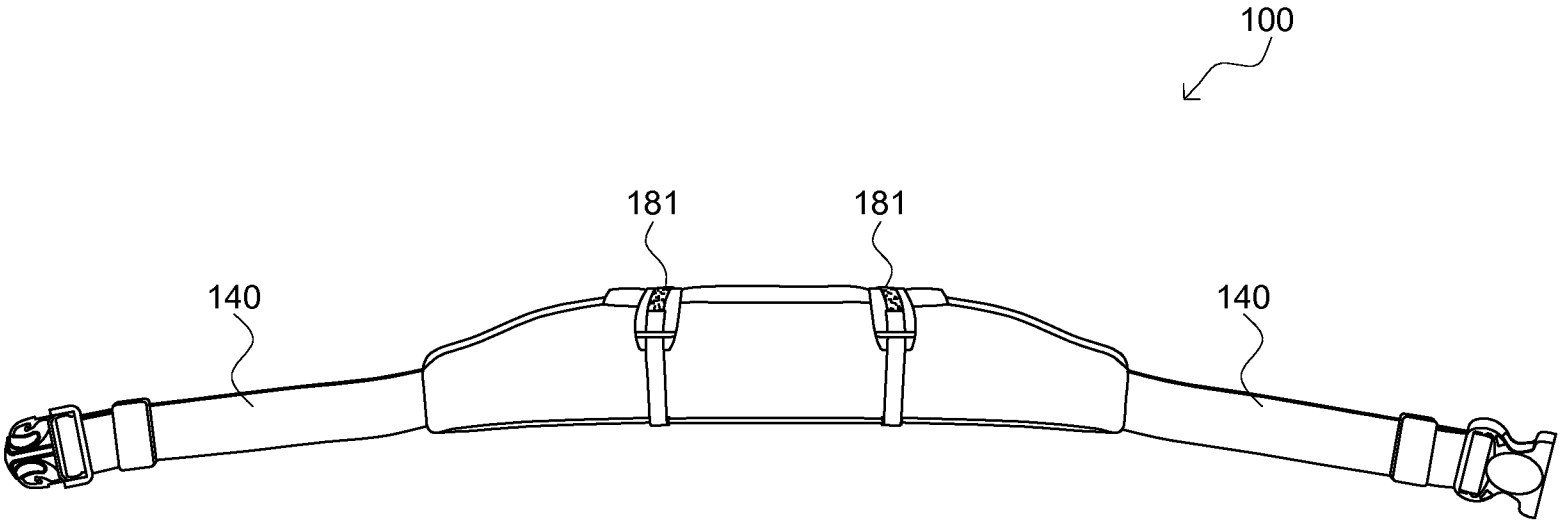
FIG. 5 is a perspective view of child carrier rolled into a compact configuration, according to an embodiment of the present invention.

As illustrated in FIG. 5, the first embodiment child carrier 100 is adapted to assume a compact configuration in which the shoulder straps and receptacle panel roll up and are bound by the foot loops 181. So configured, a child carrier that does not contain a child can be conveniently worn around a user's waist, or otherwise conveniently carried.

Figure 6:
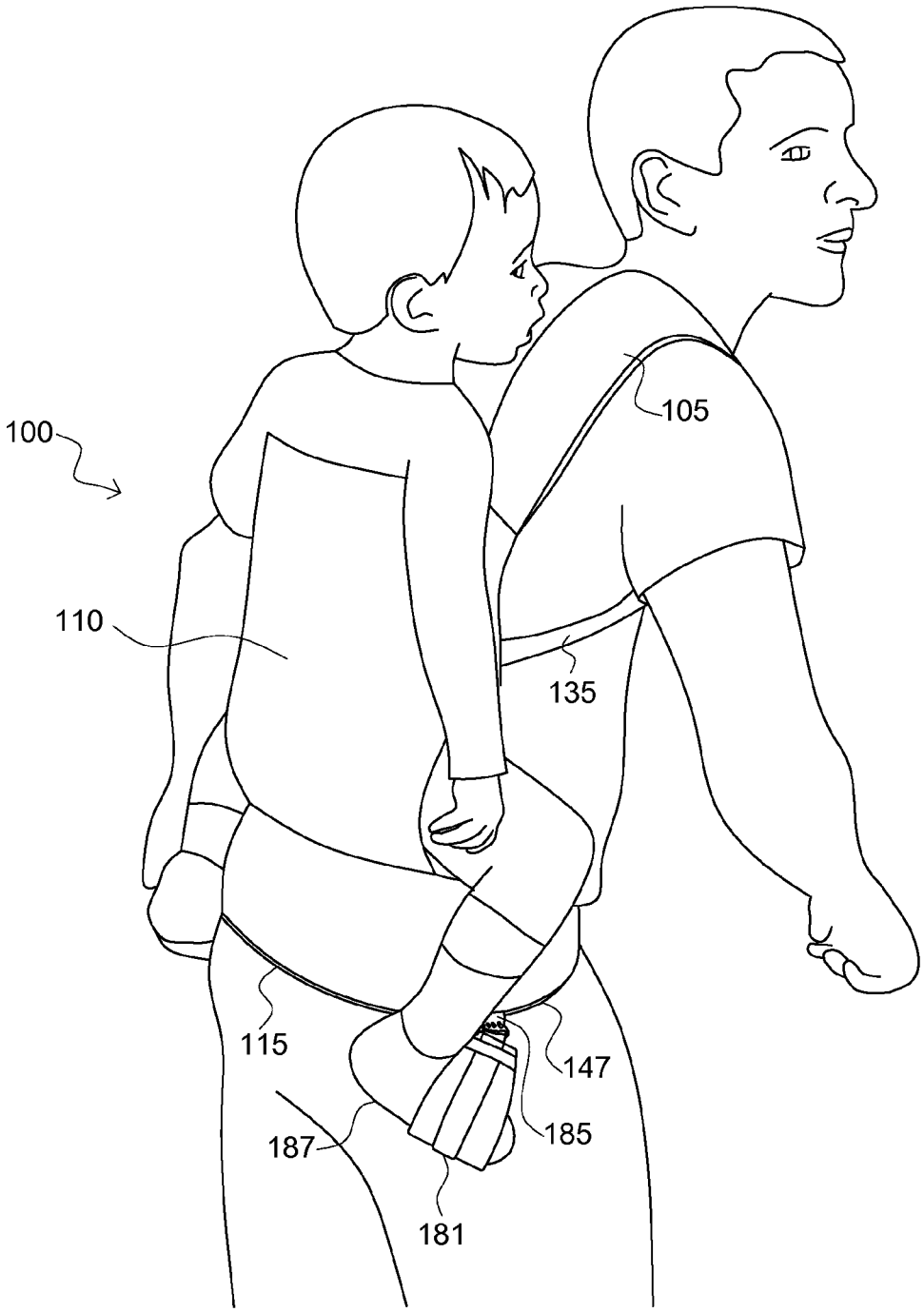
FIG. 6 is a perspective view of an adult wearing a child carrier in which a child resides, according to an embodiment of the present invention.

In FIG. 6, a first embodiment child carrier 100 is illustrated holding a child and being worn as a backpack. The child is held close to a person's torso by the receptacle panel 110. The child's legs extend beyond the receptacle panel and extend over the waist belt 115. The child's feet are supported in stirrup-like fashion by the foot loops 181, which support the child's legs in a flexed, abducted position. As illustrated in FIG. 6, the child's legs are flexed at about 90° at the knees. Embodiments of the child carrier support the child's feet such that the child's legs are flexed at the knees at an angle that is preferably less than 130° and more preferably about 90°. This degree of leg flexion is comfortable for the child and prevents or minimizes impairment of circulation to the legs that can occur where the legs hang with feet relatively unsupported. The foot loops are attached to the moveable couplers 185, which are slideably attached to the track 147. The hood is not visible in FIG. 6 because it is detached from the receptacle panel.

A Second Embodiment Child Carrier

Figure 7:
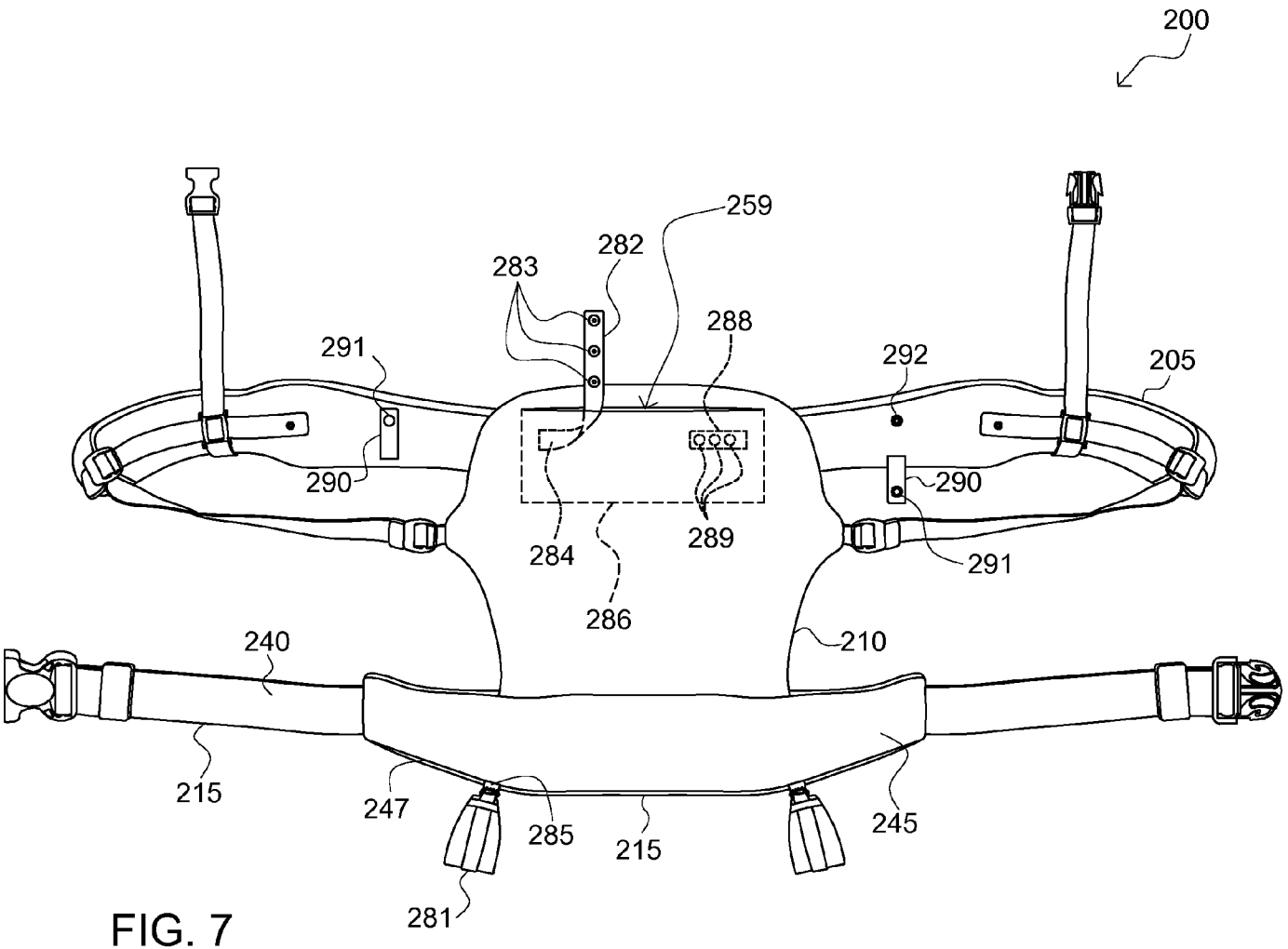
FIG. 7 is an outside perspective view of a child carrier according to an embodiment of the present invention.
Figure 8:
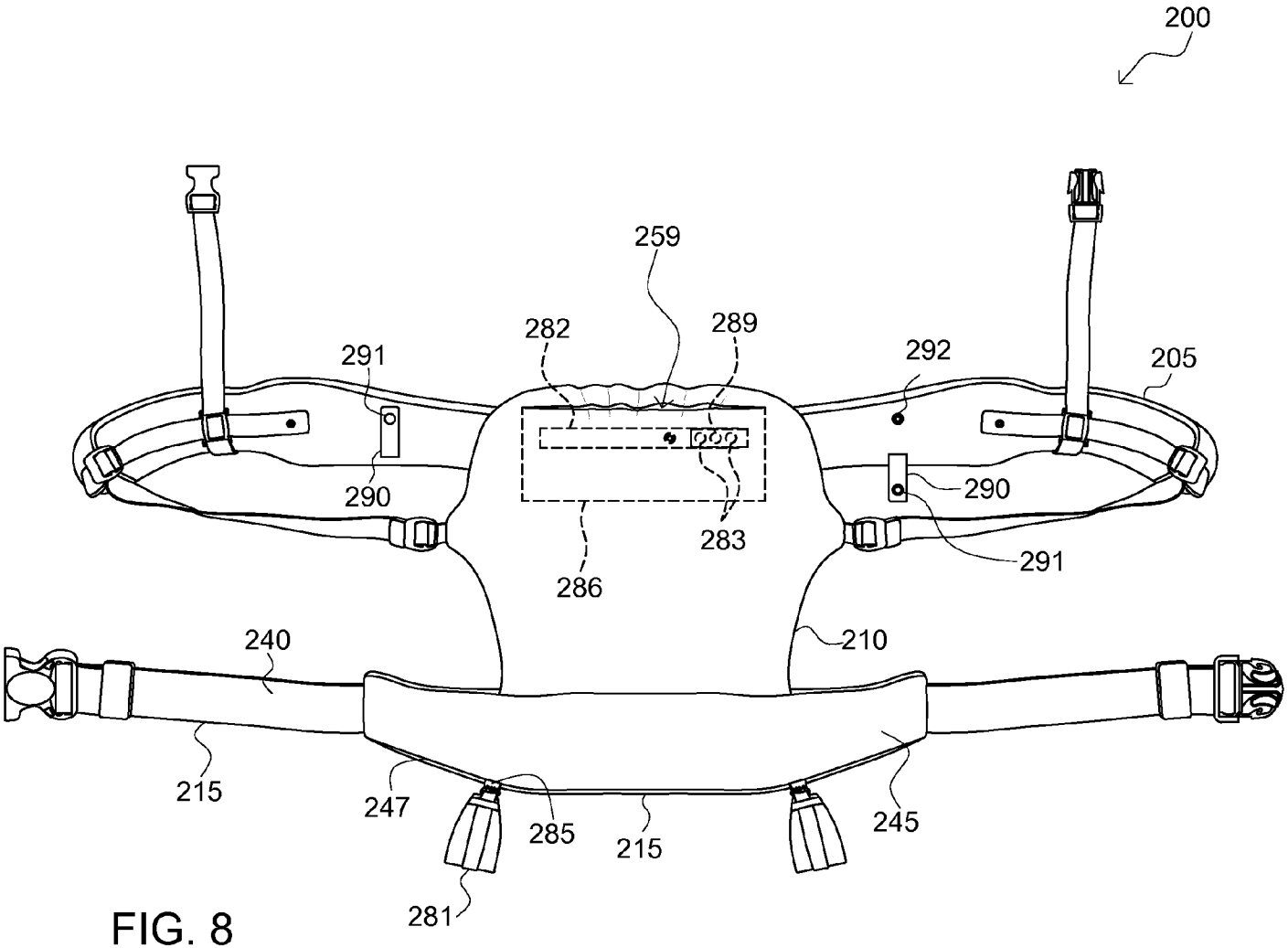
FIG. 8 is an outside perspective view of a child carrier according to an embodiment of the present invention.
Figure 9:
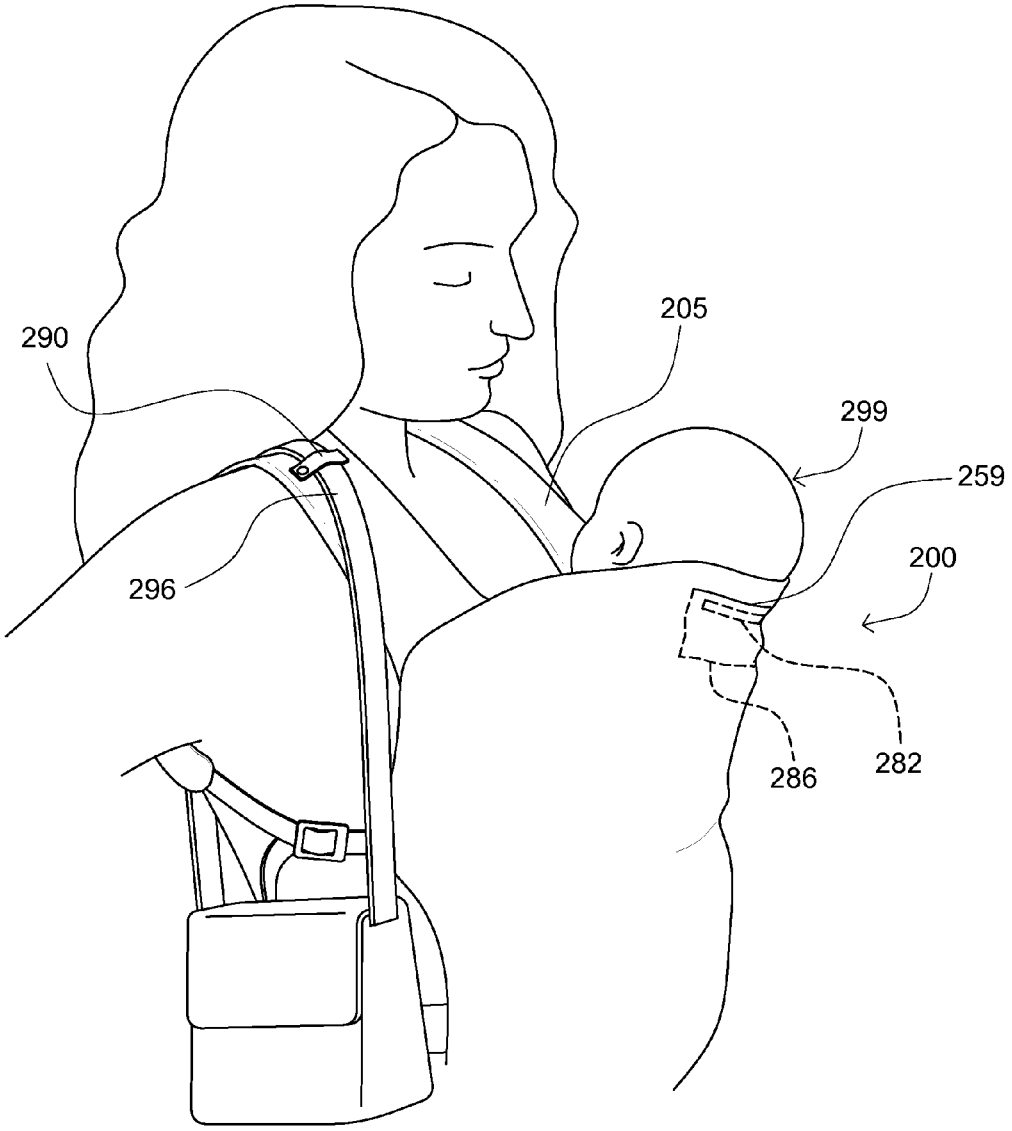
FIG. 9 is a perspective view of an adult wearing a child carrier in which a child resides, according to an embodiment of the present invention.
Figure 10:
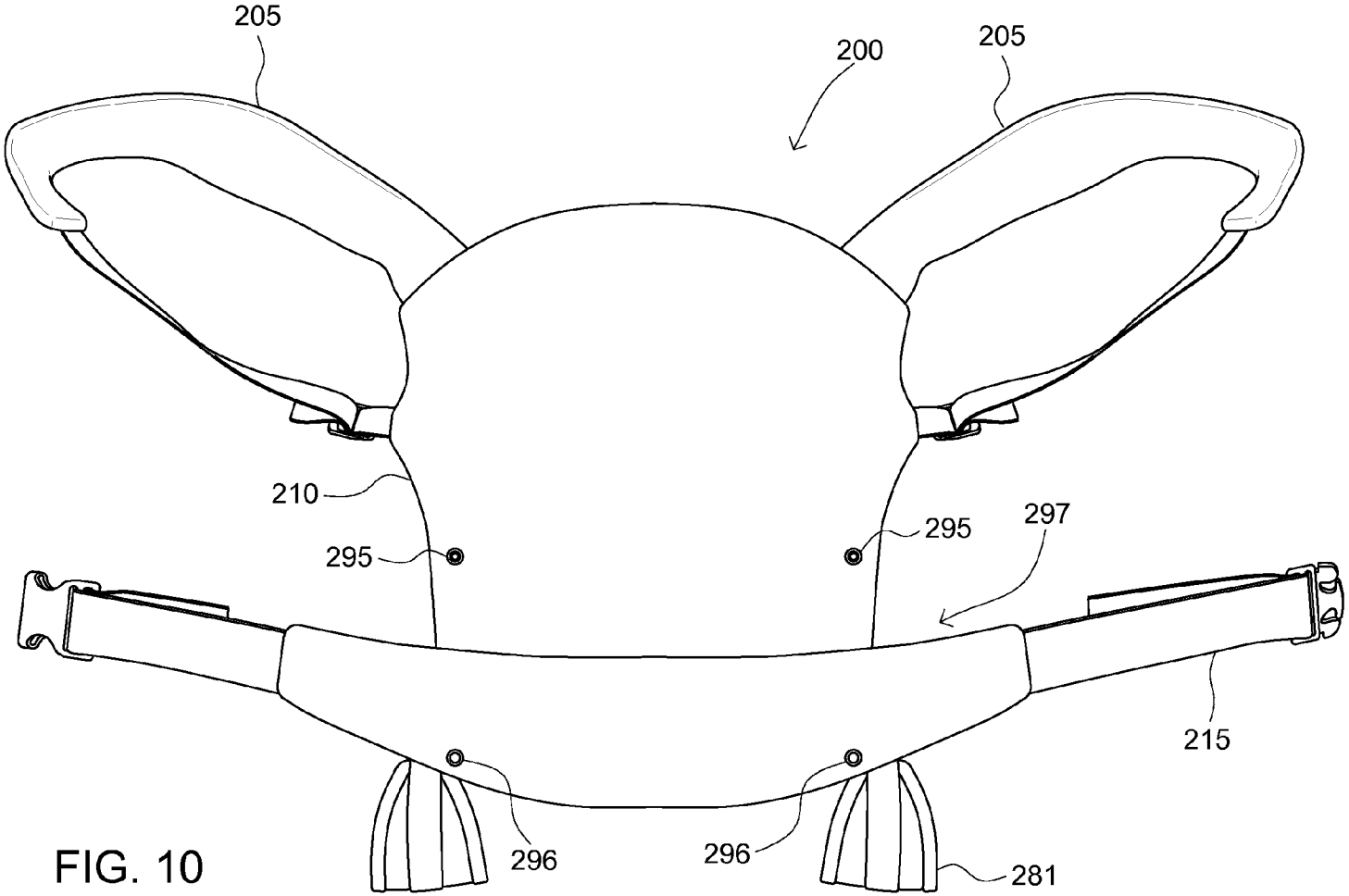
FIG. 10 is an inside perspective view of a child carrier according to an embodiment of the present invention.
Figure 11:
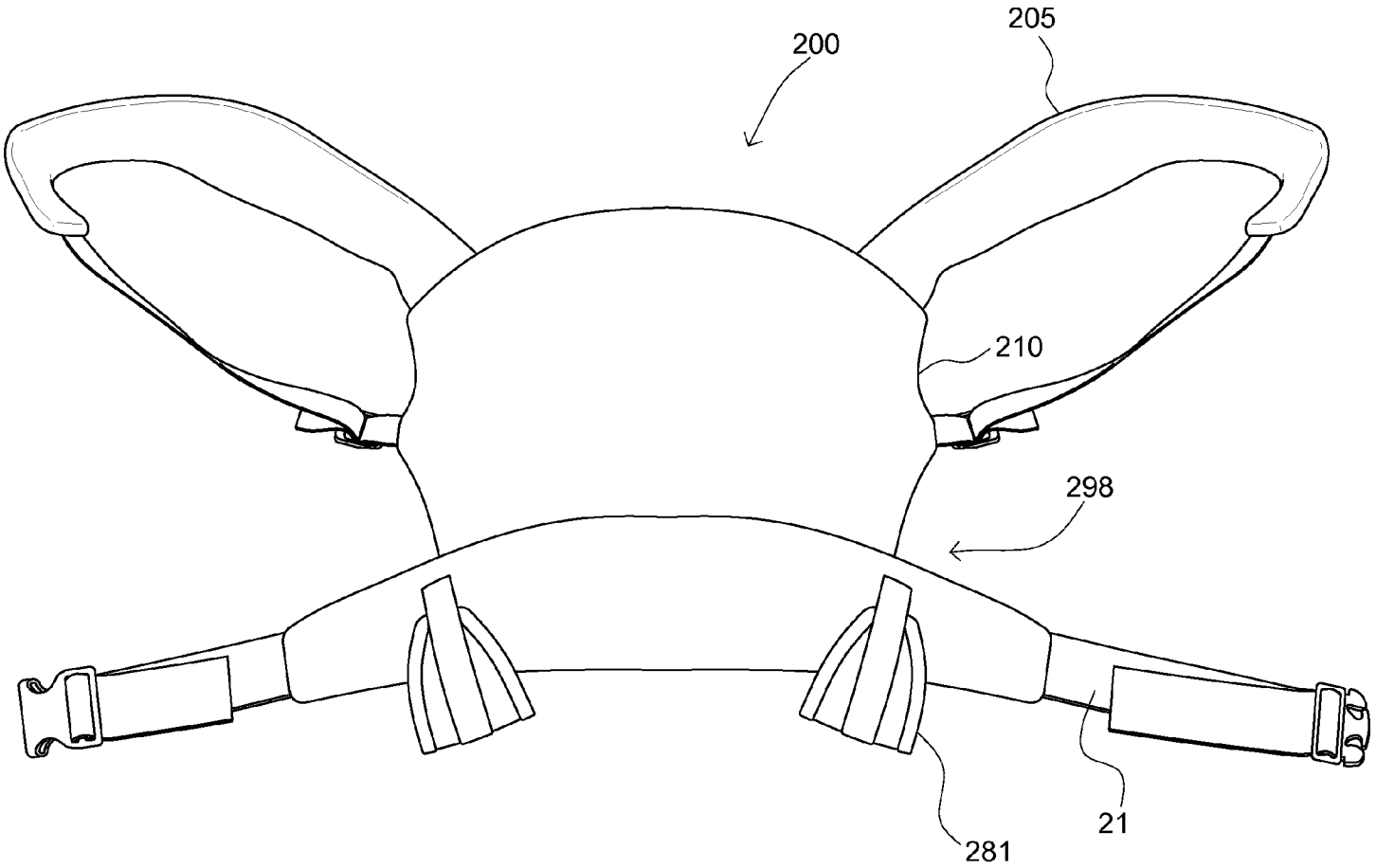
FIG. 11 is an inside perspective view of a child carrier according to an embodiment of the present invention.

A second embodiment child carrier 200 is illustrated in FIGS. 7-11. As shown in FIGS. 7 and 8, the second embodiment child carrier comprises shoulder straps 205, a receptacle panel 210, and a waist belt 215. Each of the shoulder straps 205 is coupled to the receptacle panel 210 at two connection points, an upper connection point 206 residing at a top portion of the receptacle panel and a lower connection point 207 residing below the upper connection point. The top portion of the receptacle panel is limited to the top ⅓ of the receptacle panel. The lower connection point typically couples the shoulder strap directly to the receptacle panel or directly to the waist belt. Upper and lower connection points are illustrated in FIGS. 7-11.

The waist belt 215 comprises a strap portion 240 and a middle portion 245, with a track 247 being disposed on the middle portion. The track typically comprises piping with a diameter of about 4 mm. Foot loops 281 are coupled to the track 247 by use of moveable couplers 285. The moveable couplers are adapted to slide along the track 247 such that points at which the foot loops attach to the waist belt can be changed by sliding the moveable couplers along the track.

The second embodiment child carrier 200 further comprises an infant head support, the infant head support including a head strap 282 and strap anchor 288. A first end 284 of the head strap is securely fastened to the receptacle panel inside a pocket 286 disposed on the receptacle panel 210, and the strap anchor 288 resides in the pocket 286 as well. First couplers 283 residing on a portion of the head strap 282 are adapted to engage second couplers 289 residing on the strap anchor 288, and to readily disengage therefrom. Accordingly, the head strap is adapted to removably directly couple to the strap anchor 288, with the first couplers 283 and second couplers 289 forming a detachable coupling. The first and second couplers of the second embodiment are snaps. In other embodiments, other couplers such as, but not limited to, buttons/button holes and hook and loop couplers can be used. The pocket 286 includes a pocket aperture 259 that provides access into the pocket. The pocket aperture 259 is typically fitted with a zipper (not shown) for opening and closing the aperture.

The head strap 282 is illustrated in FIG. 7 in a disengaged configuration, extending out of the pocket 286 with the first end secured inside the pocket and the first couplers 283 disengaged from the second couplers 289. In FIG. 8, the head strap 282 is shown in an engaged configuration, wherein it resides entirely within the pocket 286 with the first couplers engaging the second couplers. In an engaged configuration, the head strap is adapted to provide support for an infant's head 299, as illustrated in FIG. 9. The first couplers are adapted to engage the second couplers in multiple positions, thereby making an effective length of the head strap adjustable while the head strap is in an engaged configuration. Accordingly, the head support is adapted to provide varying degrees of support to an infant's head. Where the head strap is in an engaged configuration, it causes the receptacle panel 210 to pucker somewhat in an area proximate the pocket aperture 259, as seen in FIG. 8.

As illustrated in FIGS. 7 and 8, the second embodiment child carrier 200 further comprises a shoulder bag strap holder residing on each shoulder strap 205. The shoulder bag strap holder comprises a flap 290 on which resides a third coupler 291, and a forth coupler 292 adapted to engage the third coupler and also to readily disengage therefrom. The third and fourth couplers of the second embodiment are snaps. In other embodiments, other couplers such as, but not limited to, buttons/button holes and hook and loop couplers can be used.

The flap 290 is typically aligned along an axis that is within 45° of a transverse axis of the shoulder strap, and also intersects the transverse axis. The flap 290 is usually not as long as the shoulder strap 205 is wide at the transverse axis. Accordingly, the shoulder strap 205 of the second embodiment is about 3.5 inches wide at the transverse axis, and the flap 290 is about 2.75 inches long.

Where the third coupler 291 is disengaged from the fourth coupler 292, as shown on the right shoulder strap 205 in FIGS. 7 and 8, the purse strap holder is in an open configuration. Where the third coupler 291 engages the fourth coupler 292, as shown on the left shoulder strap in FIGS. 7 and 8, the purse strap holder is in a closed configuration.

The shoulder bag strap holder is adapted to prevent a shoulder bag strap 296 from sliding or otherwise falling from a user's shoulder. As best seen in FIG. 9, he shoulder bag strap is restricted in place on a user's shoulder by the shoulder bag strap holder in a closed position. The shoulder bag strap holder 290 is effective when disposed at or proximate an apex of a user's shoulder, as shown in FIG. 9. In the closed position, the shoulder bag strap holder 290 forms a loop through which the shoulder bag strap 296 passes in order to restrict movement of a shoulder strap trapped therein. In the open position, the loop is eliminated. The shoulder bag illustrated in FIG. 9 is a purse, and the shoulder bag strap 296 is thus a purse strap. Other shoulder bags include, but are not limited to, brief cases, computer bags, messenger bags, and diaper bags.

The second embodiment child carrier 200 further comprises a removable hood similar to that of the first embodiment child carrier 100 shown in FIGS. 1-6. The hood of the second embodiment is not illustrated in FIGS. 7-11, having been removed in order to better show other features of the child carrier. The hood of the second embodiment detachably couples to the receptacle panel 210 via snaps disposed inside the pocket 286. The hood can be stowed within the pocket whether or not the hood is coupled to or detached from the receptacle panel.

As seen in FIG. 10, the second embodiment child carrier 200 further comprises upper couplers 295 disposed on an inside of the receptacle panel 210, and lower couplers 295B disposed on an inside of the waist belt 215. The upper couplers 295 are adapted to engage the lower couplers 295B, and to readily disengage therefrom. The upper and lower couplers of the second embodiment are snaps. In other embodiments, other couplers such as, but not limited to, buttons/button holes and hook and loop couplers can be used. With the waist belt 215 folded up so that the upper couplers engage the lower couplers, the child carrier is in a short configuration, as shown in FIG. 11. Where the upper couplers are disengaged from the lower couplers and the waist belt 215 unfolds from the short configuration, the child carrier is in a long configuration. The upper and lower couplers are thus components of a shortening mechanism.

A Third Embodiment Child Carrier

Figure 12:
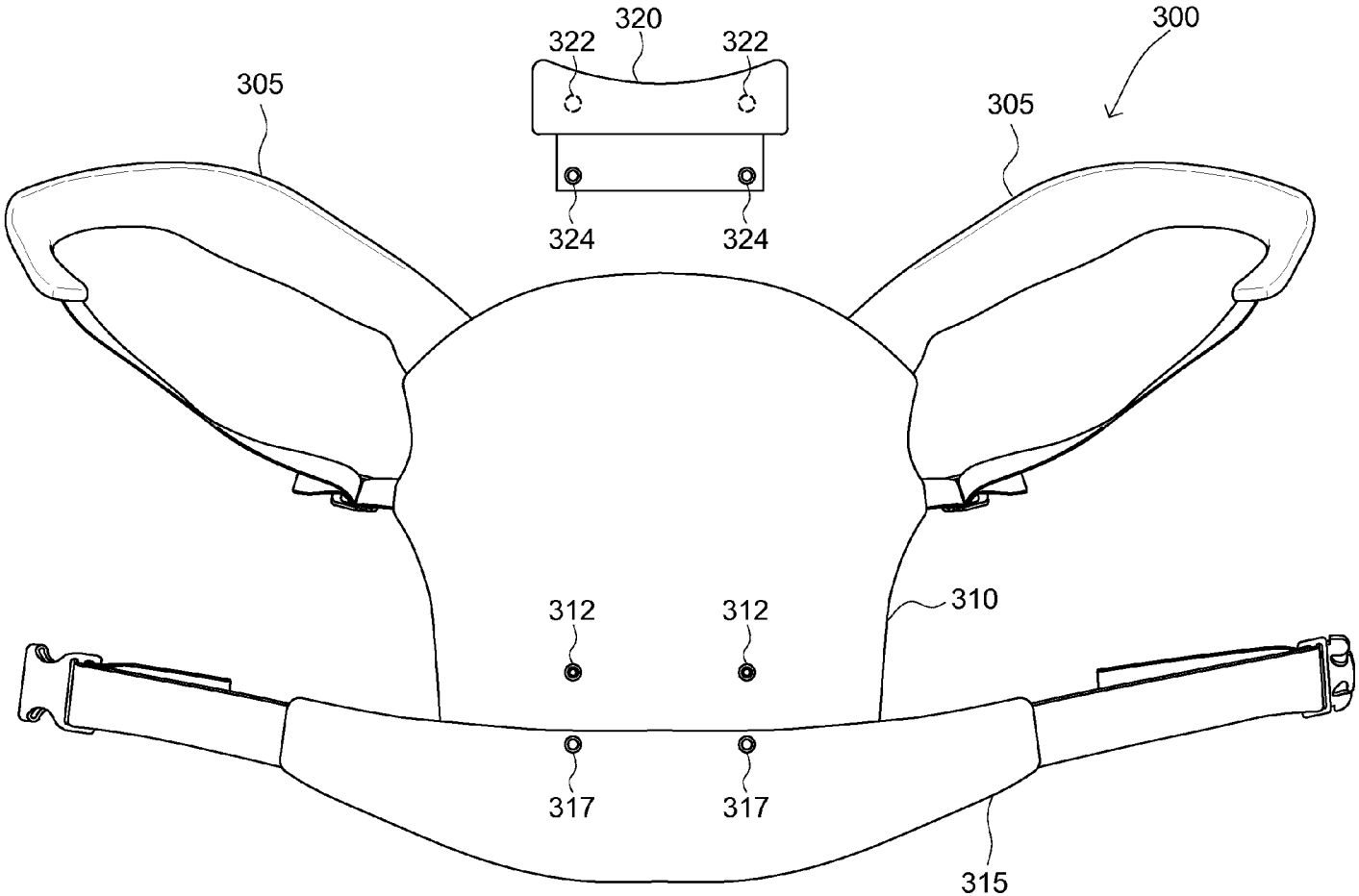
FIG. 12 is an inside perspective view of a child carrier according to an embodiment of the present invention.
Figure 13:
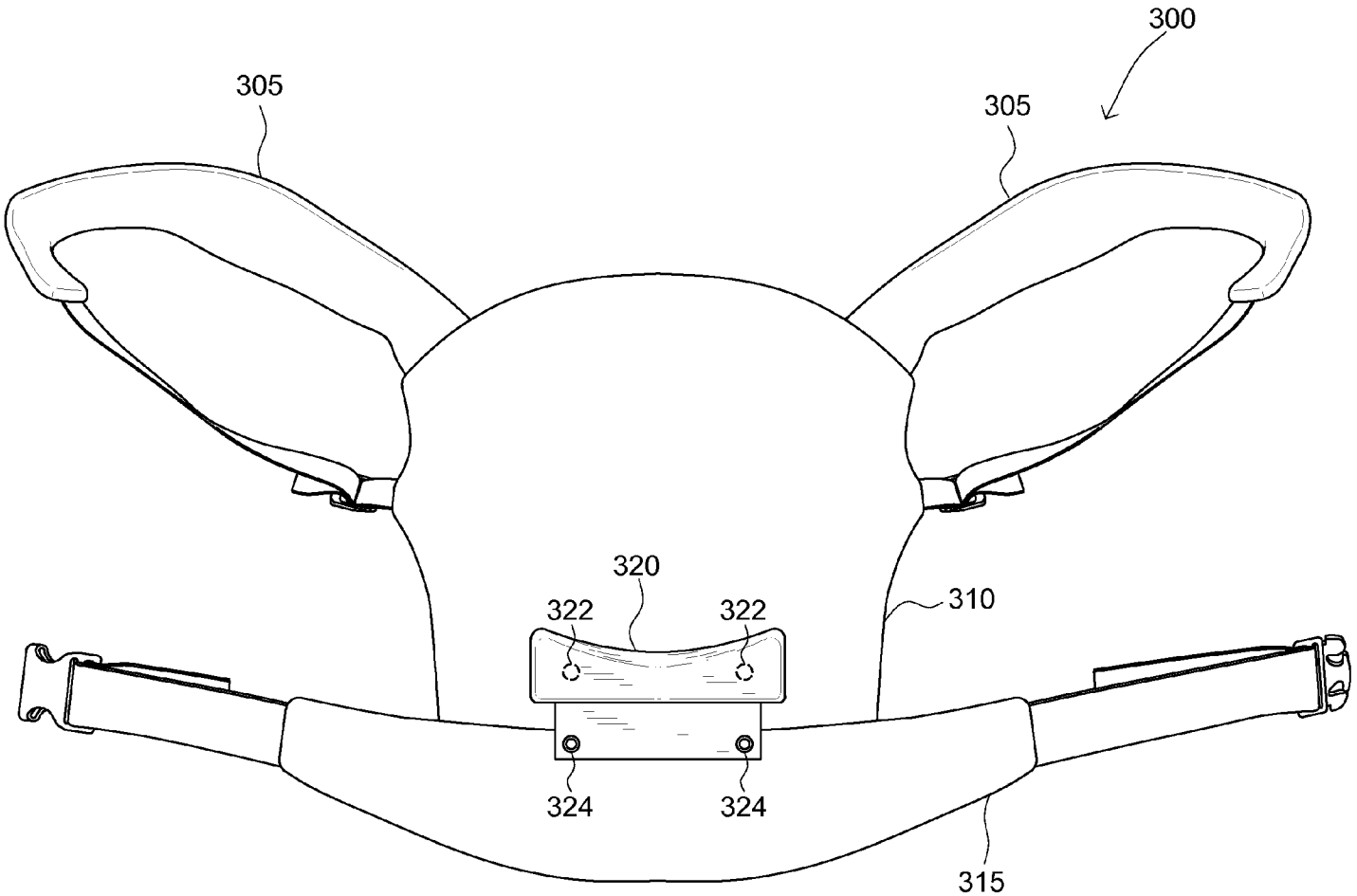
FIG. 13 is an inside perspective view of a child carrier according to an embodiment of the present invention.
Figure 14:
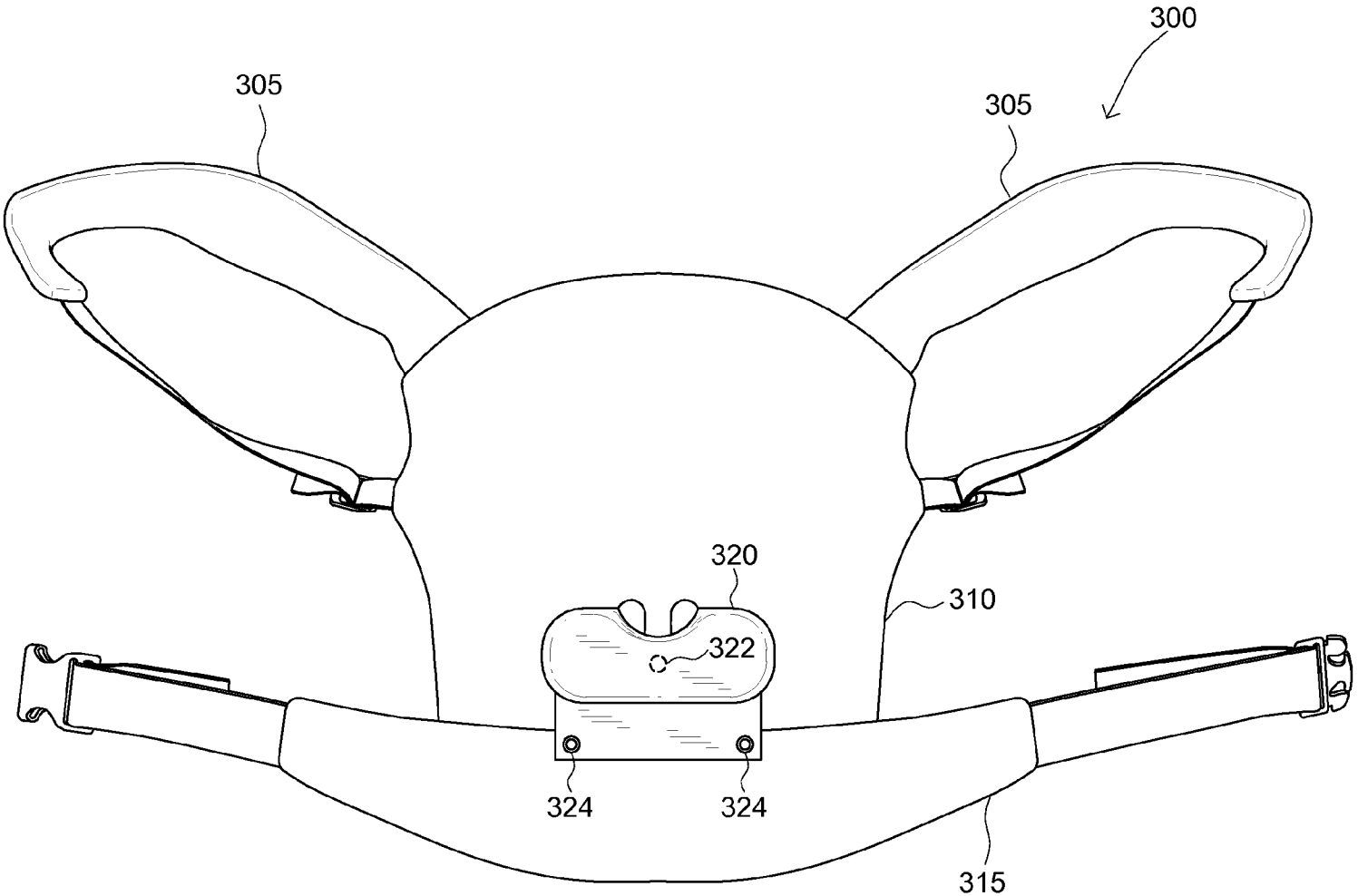
FIG. 14 is an inside perspective view of a child carrier according to an embodiment of the present invention.

A third embodiment of a child carrier 300 is illustrated in FIGS. 12-14. As shown in FIGS. 12-14, the third embodiment child carrier 300 comprises shoulder straps 305, a receptacle panel 310, a waist belt 315, and a support device 320. Each of the shoulder straps 305 is coupled to the receptacle panel 310 at two connection points, an upper connection point residing at a top portion of the receptacle panel and a lower connection point residing below the upper connection point. The top portion of the receptacle panel is limited to the top ⅓ of the receptacle panel. The lower connection point typically couples the shoulder strap directly to the receptacle panel or directly to the waist belt.

Generally, the support device 320 can be implemented to support an infant. In an embodiment, the support device 320 can have a concave face on a top side of the support device 320. For instance, a top portion of the support device 320 can have a concave shape. The concave face can be adapted to interface with a buttocks/torso of an infant or toddler. In one embodiment, the support device 320 can be padded to provide cushioned support to the infant or toddler. The support device 320 can include a first pair of attachment structures 322 and a second pair of attachment structures 324, as shown in FIG. 12.

Generally, a pair of attachment structures 312 can be located approximate a lower portion of the receptacle panel 310 and a pair of attachment structures 317 can be located approximate an upper portion of the waist belt 315, as shown in FIG. 12. It is to be appreciated that the receptacle attachment structures 312 and the waist belt attachment structures 317 can include, but are not limited to, snap fasteners, hook and loop material, buttons, and zip fasteners.

As shown in FIG. 13, the support device 320 can generally be located approximate a lower portion of the receptacle panel 310 and an upper portion of the waist belt 315. The first pair of attachment structures 322 can interface and removably couple with the receptacle attachment structures 312. The second pair of attachment structures 324 can interface and removably couple with the waist belt attachment structures 317. It is to be appreciated that the first pair of attachment structures 322 and the second pair of attachment structures 324 can include, but are not limited to, snap fasteners, hook and loop material, buttons, and zip fasteners.

Generally, the first pair of attachment structures 322 and the receptacle attachment structures 312 can be the same type of coupling. For instance, the first pair of attachment structures 312 can be male snap fasteners and the receptacle attachment structures 312 can be female snap fasteners. The second pair of attachment structures 324 and the waist belt attachment structures 317 can be the same type of coupling. It is to be appreciated that the first pair of attachment structures 322 and the second pair of attachment structures 324 can be different types of couplings.

In a first orientation or position, as shown in FIG. 13, each of the attachment structures of the support device 320 can interface and couple with the attachment structures of the child carrier 300. The first pair of attachment structures 322 can mate with the receptacle attachment structures 312 and the second pair of attachment structures 324 can mate with the waist belt attachment structures 317. The first position can generally be implemented for larger children. For instance, the first position can be implemented for infants weighing between 10-17 lbs.

In a second orientation or position, as shown in FIG. 14, the first pair of attachment structures 322 can mate with each other and the second pair of attachment structures 324 can mate with the waist belt attachment structures 317. In the second position, an upper portion of the support device 320 can be folded. The second position can be generally implemented for smaller infants and newborns. For instance, the second position can be implemented for infants weighing between 7-10 lbs. It is to be appreciated that the coupling 322 shown in FIG. 14 is for illustrative purposes only and is not meant to be limiting. The dashed lines of the coupling 322 show a general location of the coupling 322, but an orientation of the dashed lines has been changed for illustrative purposes only.

In a third orientation or position, the first pair of attachment structures 322 can mate to each other and the second pair of attachment structures 324 can mate with the receptacle attachment structures 312. In such an orientation, the support device 320 can be elevated in relation to the support device 320 in the first position and the second position. The third position can generally be implemented for newborns or to elevate an infant.

In one embodiment, the second pair of attachment structures 324 can mate to each other and the first pair of attachment structures 322 can mate to the receptacle attachment structures 312.

A Fourth Embodiment Child Carrier

Figure 15:
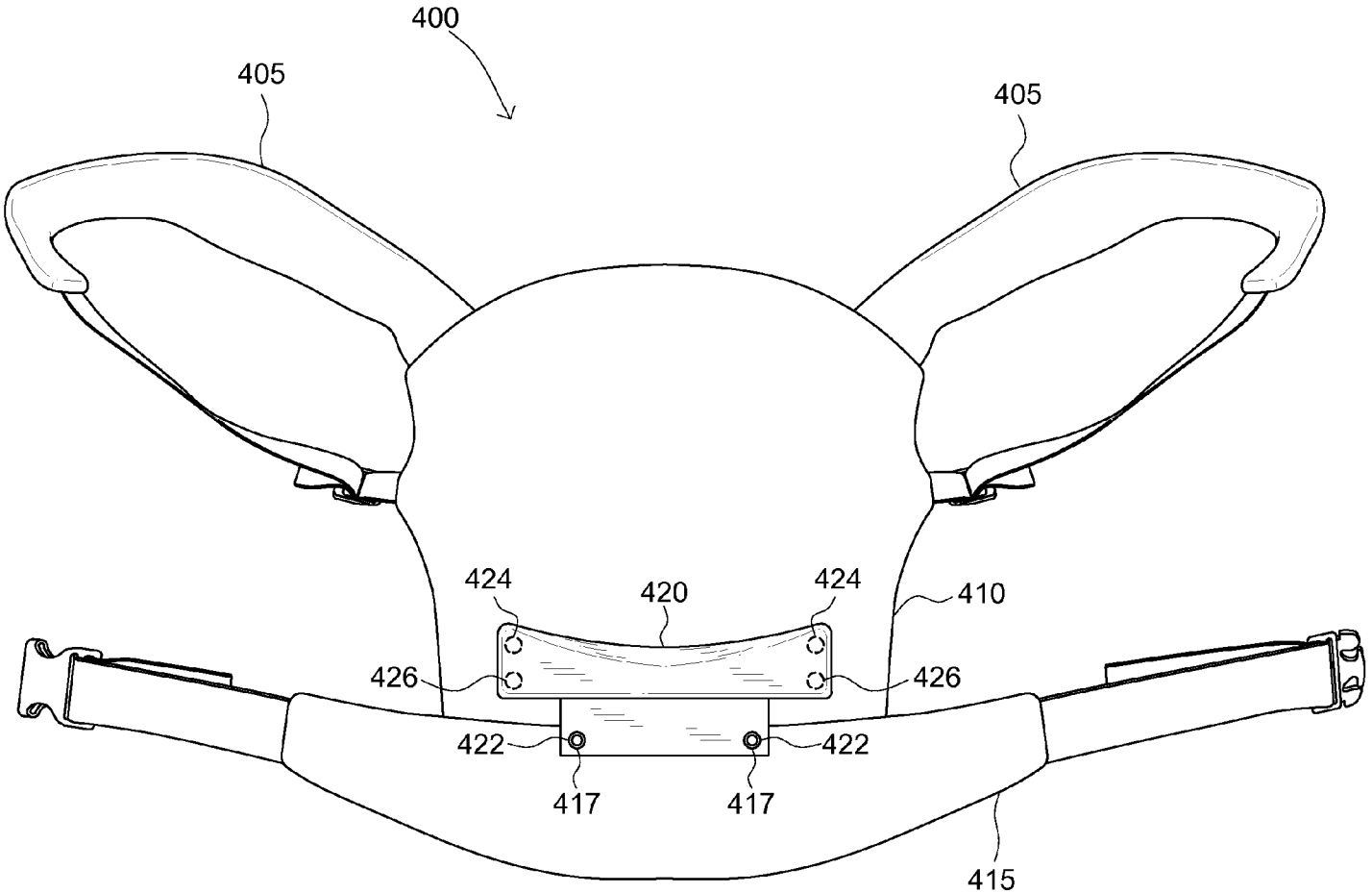
FIG. 15 is an inside perspective view of a child carrier according to an embodiment of the present invention.
Figure 16:
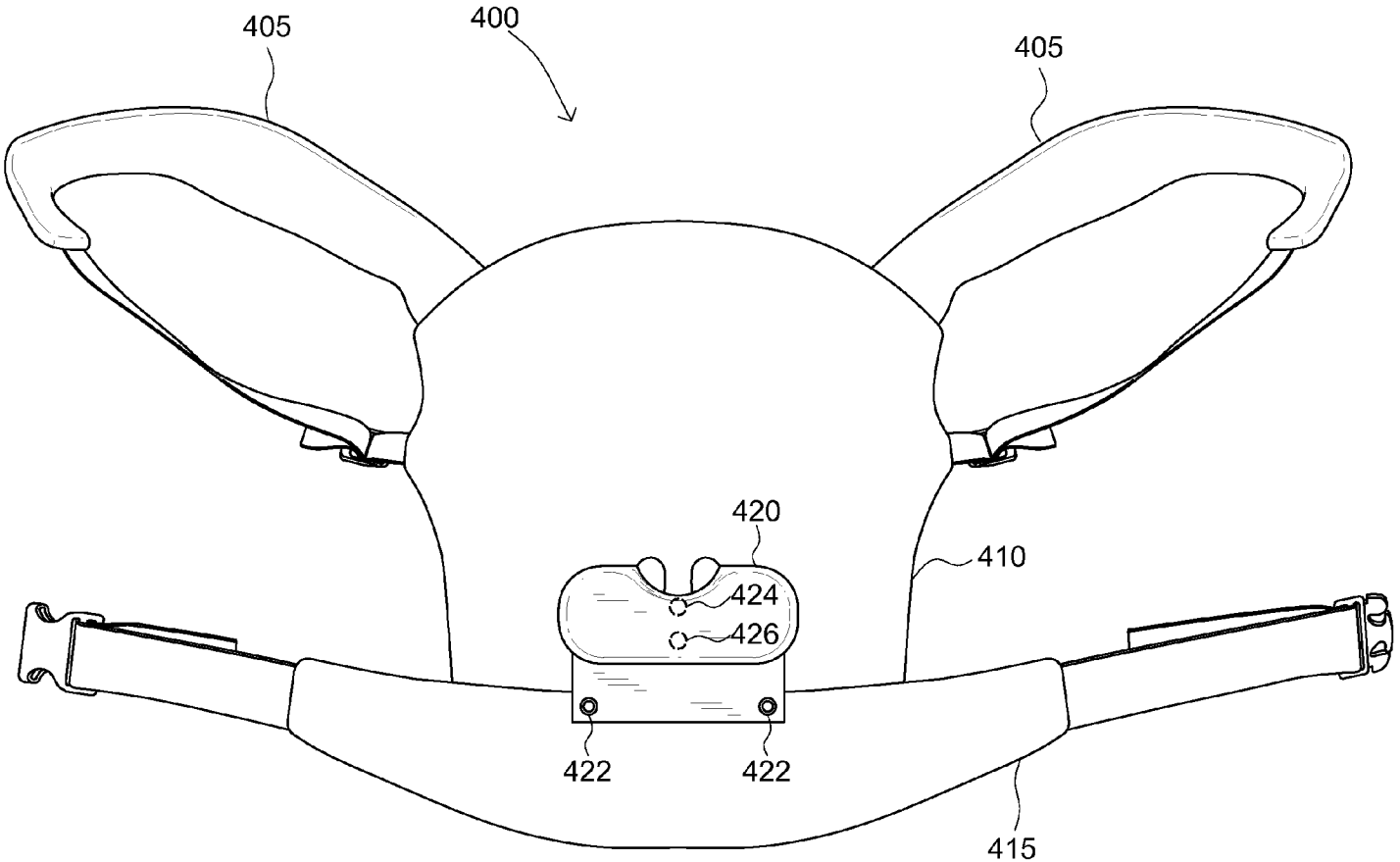
FIG. 16 is an inside perspective view of a child carrier according to an embodiment of the present invention.

A fourth embodiment of a child carrier 400 is illustrated in FIGS. 15-16. As shown in FIGS. 15 and 16, the fourth embodiment child carrier comprises shoulder straps 405, a receptacle panel 410, a waist belt 415, and a support device 420.

Generally, the support device 420 can be implemented to support an infant or toddler. In one embodiment, the support device 420 can include a concave face on a top side of the support device 420 adapted to interface with a buttocks/torso of an infant or toddler. For instance, a top portion of the support device 420 can have a concave shape. Generally, the support device 420 can be padded to provide cushioned support to the infant or toddler.

In one embodiment, the support device 420 can include a plurality of attachment structures. A first pair of attachment structures 422 can be implemented to couple the support device 420 to the child carrier 400. As shown in FIG. 15, the support device 420 can generally be located approximate a lower portion of the receptacle panel 410 and an upper portion of the waist belt 415. The waist belt 415 can include a pair of attachment structures 417 located approximate an upper portion of the waist belt 415. The waist belt attachment structures 417 can be implemented to mate with the first pair of attachment structures 422 to secure the support device 420 to the child carrier 400. Typically, the first pair of attachment structures 422 can be removably coupled to the waist belt attachment structures 417.

The support device 420 can include a second pair of attachment structures 424 and a third pair of attachment structures 426. The second pair of attachment structures 424 can be adapted to mate to each other and the third pair of attachment structures 426 can be adapted to mate to each other. It is to be appreciated that the waist belt attachment structures 417, the first attachment structures 422, the second attachment structures 424, and the third attachment structures 426 can include, but are not limited to, snap fasteners, hook and loop material, buttons, and zip fasteners.

In a first orientation or position, as shown in FIG. 15, the first pair of attachment structures 422 can be mated to the waist belt attachment structures 417, the second pair of attachment structures 424 can be uncoupled, and the third pair of attachment structures 426 can be uncoupled. The first position can generally be implemented for larger infants. For instance, the first position can be implemented for infants weighing between 10-17 lbs.

In a second orientation or position, as shown in FIG. 16, the first pair of attachment structures 422 can be mated to the waist belt attachment structures 417, the second pair of attachment structures 424 can be mated to each other, and the third pair of attachment structures 426 can be mated to each other. In the second position, the support device 420 can be folded, providing an area for a lighter infant to interface with. The second position can be generally implemented for smaller infants and newborns. For instance, the second position can be implemented for infants weighing between 7-10 lbs. It is to be appreciated that in some embodiments of the second position, the second pair of attachment structures 424 or the third pair of attachment structures 426 may not be mated to themselves. It is to be appreciated that the couplings 424, 426 shown in FIG. 16 are for illustrative purposes only and are not meant to be limiting. The dashed lines of the couplings 424, 426 show a general location of the couplings 424, 426, but an orientation of the dashed lines has been changed for illustrative purposes only.

Figure 17:
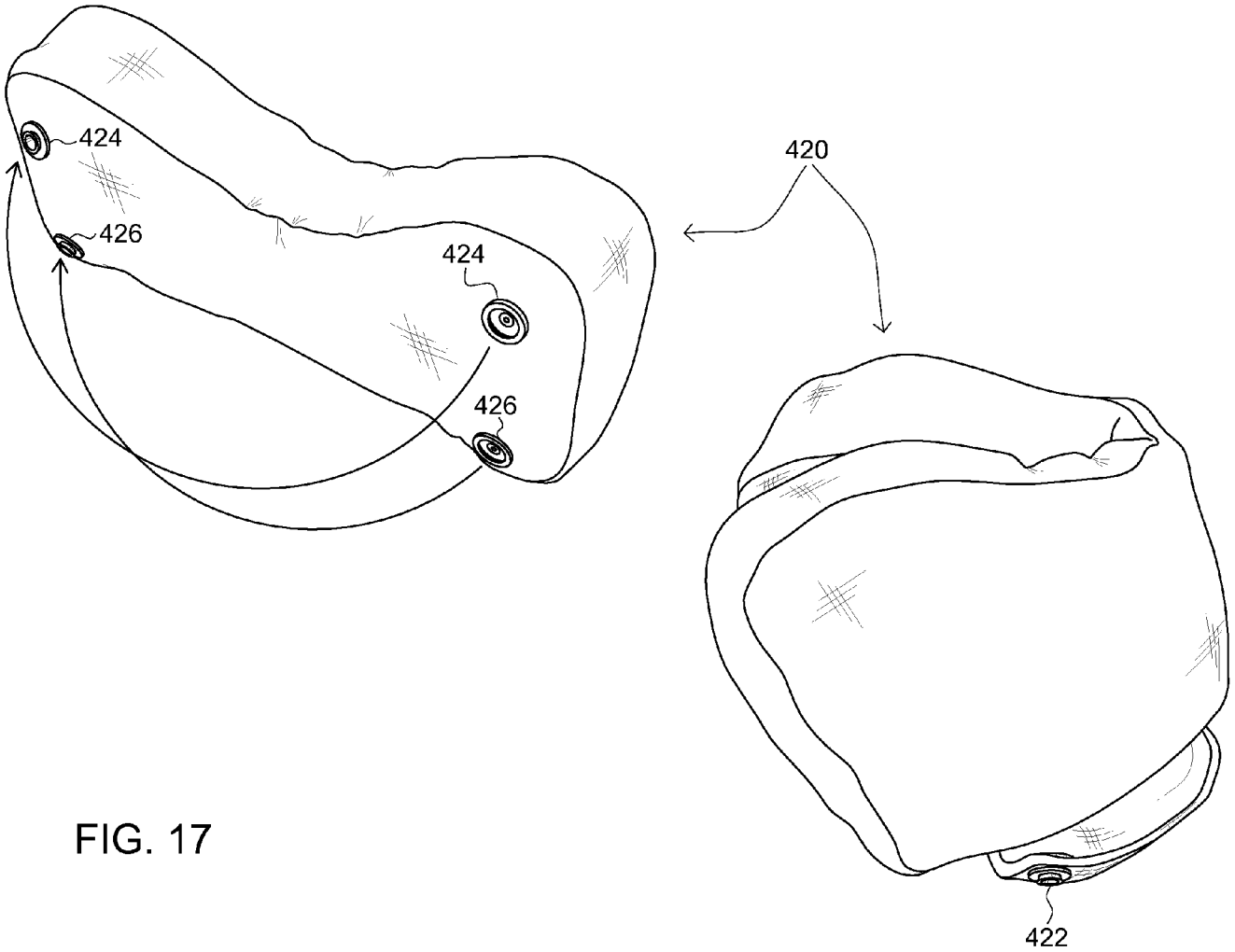
FIG. 17 is a perspective view of a support device according to an embodiment of the present invention.

Referring to FIG. 17, detailed diagrams of the support device 420 are illustrated. As shown, the support device 420 can be padded and provide a surface for the buttocks of an infant to rest on. Generally, a padded portion of the support device 420 can be approximately one inch thick. In one embodiment, the padded portion of the support device 420 can be 0.5-2 inches thick. Typically, batting can be implemented to provide cushioning to the infant. For instance, a polyester batting can be implemented as padding. It is to be appreciated that other materials including, but not limited to, cotton and wool can be implemented as padding.

Figure 18A:
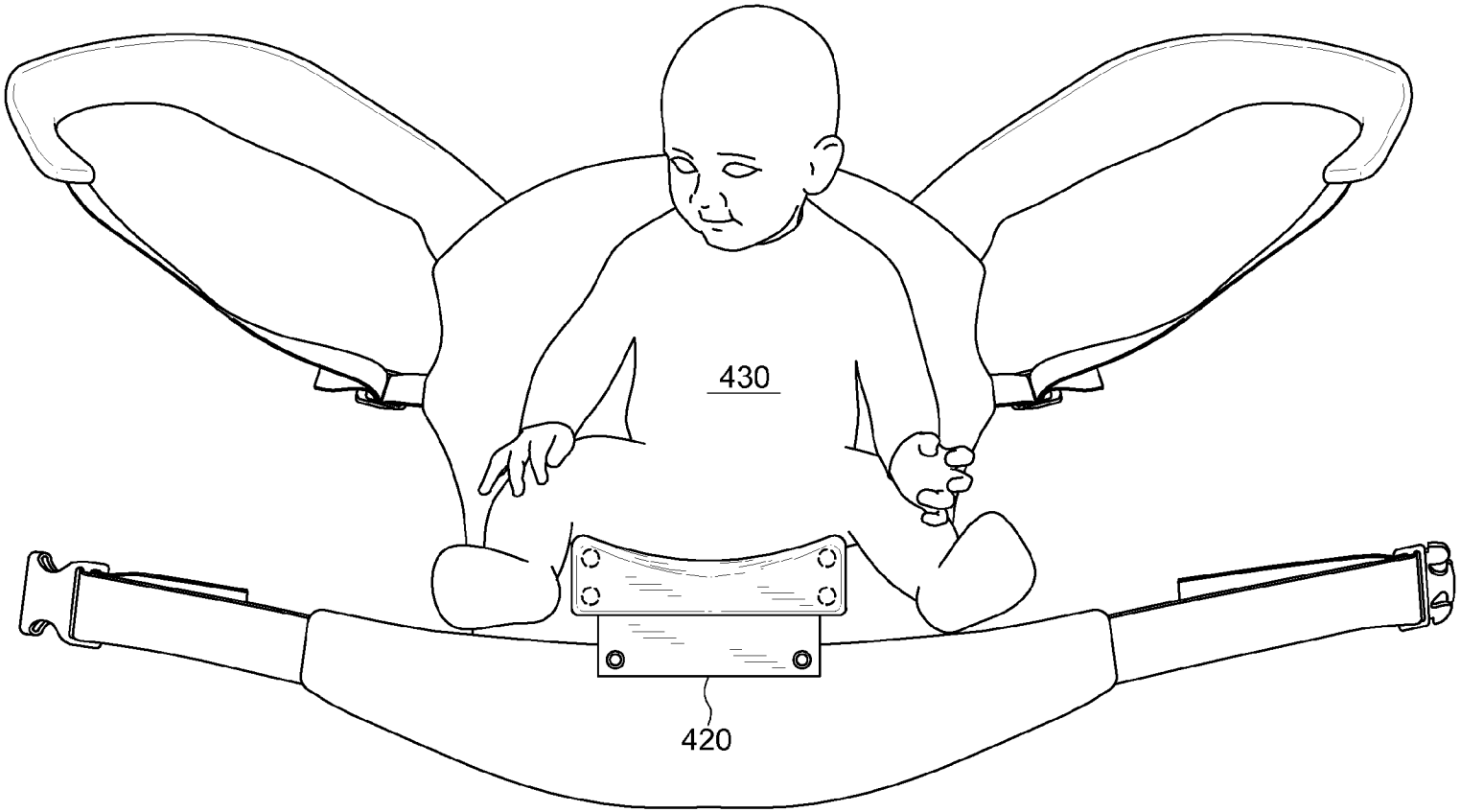
FIGS. 18A-18B are perspective views of an infant interfacing with a support device according to an embodiment of the present invention.
Figure 18B:
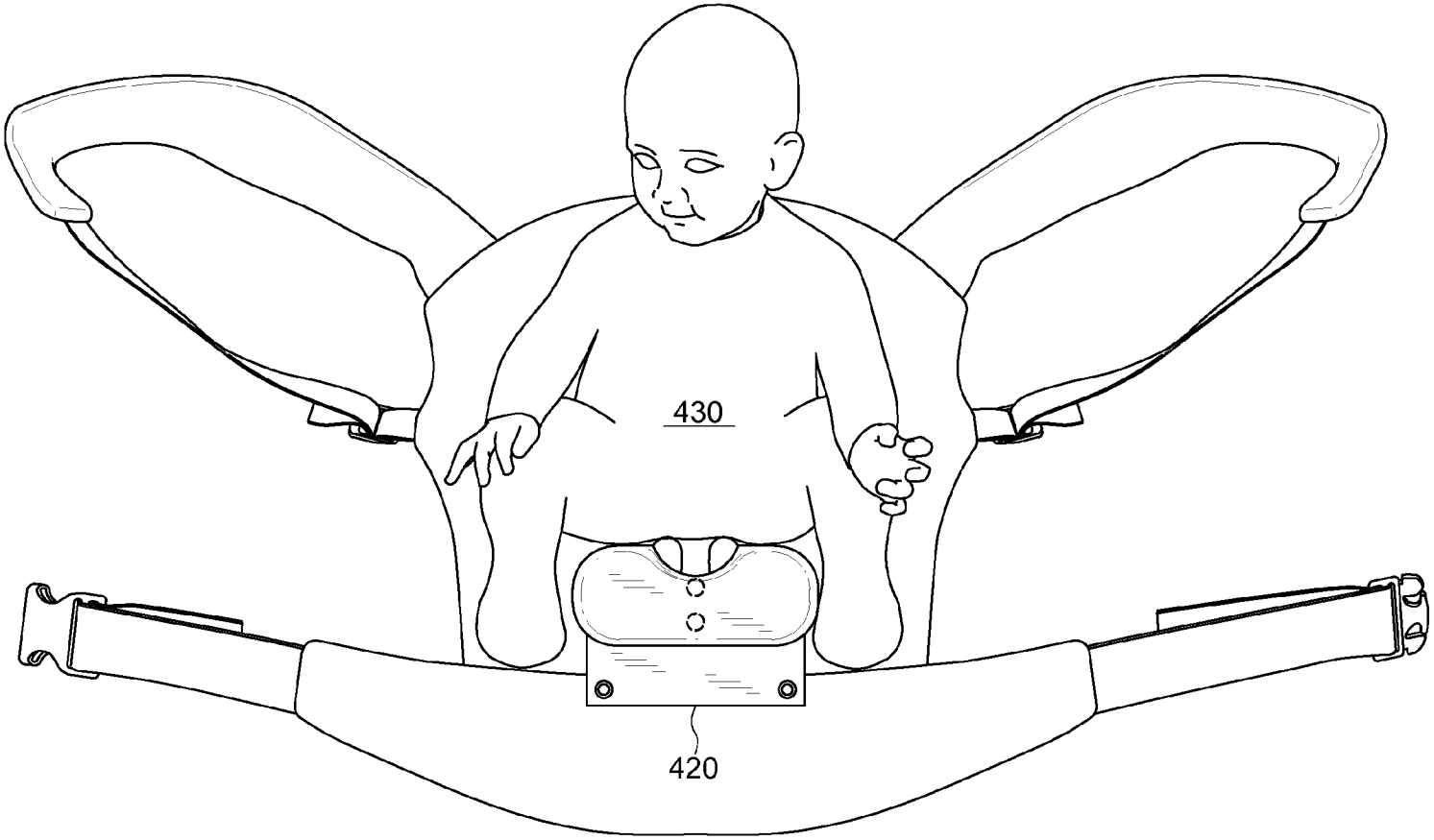

Referring to FIGS. 18A-18B, detailed diagrams of an infant 430 interfacing with the support device 420 are illustrated. It is to be appreciated that the infant 430 is for illustrative purposes only and is not meant to be limiting. As shown, buttocks of the infant 430 can interface with a top portion of the support device 420. FIG. 18A shows the infant 430 interfacing with the support device 420 when the support device is in the first position. FIG. 18B shows the infant 430 interfacing with the support device 420 when the support device is in the second position. It is to be appreciated that the support device 420 can have a variety of shapes without exceeding a scope of the present invention. For instance, the top portion can be linear or have a convex shape.

In a typical implementation, a user can attach the support device to the child carrier and secure the child carrier to them self. After the waist belt is secured and the shoulder straps are placed on shoulders of the user, the user can place an infant in the child carrier. The user can place buttocks of the infant on the support device. After the infant is in the child carrier, the user can tighten the shoulder straps and proceed using the child carrier. Depending on a weight of the infant, the user can implement the support device in the first orientation or the second orientation.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A child carrier comprising:

a receptacle panel, the receptacle panel including a supple material;

a waist belt, the waist belt being coupled to the receptacle panel and adapted to encircle a human torso;

two shoulder straps, each of the two shoulder straps being coupled to the receptacle panel; and a support device to selectively position the child within the child carrier, the support device being generally centered or proximate to a center of the receptacle panel and having a first pair of attachment structures and a second pair of attachment structures, wherein (i) the first pair of attachment structures removably couples the support device to the waist belt, and (ii) the second pair of attachment structures removably couples a first portion of the support device to a second portion of the support device.

2. The child carrier of claim 1, wherein the first pair of attachment structures comprises one of a male or female fastener on the waist belt and an other of the male or female fastener on the support device, such that the respective male and female fasteners interface to removably couple the support device to the waist belt.

3. The child carrier of claim 1, further comprising a third pair of attachment structures, wherein the first pair of attachment structures resides on the support device, wherein the third paid of attachment structures resides on the waist belt, and wherein the first pair of attachment structures mates with the third pair of attachment structures.

4. The child carrier of claim 3, wherein the support device has a first position for persons weighing a first weight range and a second position for persons weighing a second weight range, and wherein the first weight range is more than the second weight range.

5. The child carrier of claim 4, wherein when the support device is in the first position, the first pair of attachment structures is coupled to the third pair of attachment structures, and the second pair of attachment structures is uncoupled.

6. The child carrier of claim 4, wherein when the support device is in the second position, the first pair of attachment structures is coupled to the third pair of attachment structures, and the second pair of attachment structures is coupled to each other.

7. The child carrier of claim 1, wherein a top portion of the support device has a concave shape.

8. The child carrier of claim 7, wherein the support device is padded.

9. A method of using the child carrier of claim 3, the method comprising the steps of:

wearing the child carrier, wherein wearing the child carrier includes securing the child carrier to a wearer by encircling a torso of the wearer with the waist belt and placing the shoulder straps over shoulders of the wearer;

attaching the support device to the child carrier by coupling the first attachment structures to the third attachment structures; and placing a person in the child carrier, wherein a buttocks of the person rests on the support device.

10. The method of claim 9, wherein when the support device is selectively positioned to the second position, the method further comprises the step of:

coupling the second pair of attachment structures to each other.

11. A child carrier comprising:

a receptacle panel, the receptacle panel including a supple material;

a waist belt, the waist belt being coupled to the receptacle panel and adapted to encircle a human torso;

two shoulder straps, each of the two shoulder straps being coupled to the receptacle panel; and a support device generally centered or proximate to a center of the receptacle panel, the support device having a first pair of attachment structures that removably couples a first portion of the support device to the receptacle panel and a second pair of attachment structures that removably couples a second portion of the support device to the waist belt.

12. The child carrier of claim 11, wherein the first portion of the support device is proximate a lower portion of the receptacle panel, and the second portion of the support device is proximate an upper portion of the waist belt.

13. The child carrier of claim 11, further comprising:

a third pair of attachment structures residing on an inside of the receptacle panel; and a fourth pair of attachment structures residing on the waist belt.

14. The child carrier of claim 13, wherein (i) the first pair of attachment structures couples to the third pair of attachment structures, and (ii) the second pair of attachment structures couples to the fourth pair of attachment structures.

15. The child carrier of claim 13, wherein (i) the first pair of attachment structures couples to each other, and (ii) the second pair of attachment structures couples to the fourth pair of attachment structures.

16. The child carrier of claim 13, wherein (i) the first pair of attachment structures couples to each other, and (ii) the second pair of attachment structures couples to the third pair of attachment structures.

17. The child carrier of claim 11, wherein the support device is configured for persons weighing between 7-17 lbs.

18. The child carrier of claim 11, wherein a top portion of the support device has a concave shape.

19. The child carrier of claim 18, wherein the support device is padded.

20. A child carrier comprising:

a receptacle panel, the receptacle panel including a supple material and having an inside area greater than 80 square inches;

a waist belt, the waist belt being coupled to the receptacle panel and adapted to encircle a human torso;

two shoulder straps, each of the two shoulder straps being coupled to the receptacle panel at an upper connection point, the upper connection point residing at a top portion of the receptacle panel;

a shortening mechanism including an upper coupler and a lower coupler, wherein the shortening mechanism is adapted to enable the child carrier to adjust between a short configuration in which the waist belt is coupled directly to the receptacle panel at the upper coupler, and a long configuration in which the waist belt is not coupled directly to the receptacle panel at the upper coupler, wherein the upper coupler resides on the receptacle panel between the waist belt and the upper connection point when the child carrier is in the long configuration, wherein the lower coupler (i) resides on the waist belt, (ii) engages the upper coupler when the child carrier is in the short configuration, and (iii) is disengaged from the upper coupler when the child carrier is in the long configuration;

a shoulder bag strap holder, the shoulder bag strap holder comprising a loop residing on at least one of the two shoulder straps and being adapted to prevent a shoulder bag strap from sliding off a user's shoulder where the shoulder bag strap runs through the loop;

an infant head support, wherein the infant head support includes a head strap mounted substantially horizontally on a top portion of the receptacle panel, with a first end coupled directly to the receptacle panel and another portion of the head strap being directly detachably coupled to the receptacle panel;

a pocket, the pocket residing on the receptacle panel and the head strap residing in the pocket; and a support device to selectively position the child within the child carrier, the support device being generally centered or proximate to a center of the receptacle panel and being padded and having a top portion with a concave shape, the support device including a first pair of attachment structures and a second pair of attachment structures;

wherein (i) the first pair of attachment structures removably couples the support device to the waist belt, and (ii) the second pair of attachment structures removably couples a first portion of the support device to a second portion of the support device.

* * * * *